US008336583B2

(12) United States Patent
Jacobs et al.

(10) Patent No.: US 8,336,583 B2
(45) Date of Patent: Dec. 25, 2012

(54) RETRACTABLE NIB WRITING INSTRUMENT

(75) Inventors: Barry H. Jacobs, Highland Park, NJ (US); Andrew Bielecki, Evanston, IL (US)

(73) Assignee: Sanford, L.P., Oak Brook, IL (US)

( * ) Notice: Subject to any disclaimer, the term of this patent is extended or adjusted under 35 U.S.C. 154(b) by 1469 days.

(21) Appl. No.: 11/872,616

(22) Filed: Oct. 15, 2007

(65) Prior Publication Data

US 2009/0097906 A1 Apr. 16, 2009

(51) Int. Cl.
*B65B 1/30* (2006.01)

(52) U.S. Cl. ..... 141/202; 141/107

(58) Field of Classification Search ..... 401/202, 401/107, 108, 109, 98, 213
See application file for complete search history.

(56) References Cited

U.S. PATENT DOCUMENTS

| | | | | |
|---|---|---|---|---|
| 1,615,506 | A * | 1/1927 | Felt | 401/247 |
| 1,809,416 | A | 6/1931 | Liddell | |
| 2,092,459 | A | 9/1937 | Kutter | |
| 3,292,593 | A | 12/1966 | Furuya | |
| 3,362,778 | A | 1/1968 | Pavese | |
| 3,399,946 | A | 9/1968 | Tokorozawa et al. | |
| 3,427,112 | A | 2/1969 | Yanagisawa et al. | |
| 4,518,273 | A * | 5/1985 | Larizza | 401/98 |
| 4,560,298 | A | 12/1985 | Oki et al. | |
| 4,629,348 | A | 12/1986 | Hashimoto et al. | |
| 5,352,053 | A * | 10/1994 | Reitze | 401/202 |
| 6,264,080 | B1 * | 7/2001 | Ewing | 224/200 |
| D497,644 | S | 10/2004 | Piacenza et al. | |
| 7,059,796 | B2 * | 6/2006 | Lewis et al. | 401/107 |
| 2005/0191112 | A1 * | 9/2005 | Yoon | 401/108 |

FOREIGN PATENT DOCUMENTS

| | | |
|---|---|---|
| DE | 26 07 219 | 9/1977 |
| DE | 200 10 971 | 10/2000 |

OTHER PUBLICATIONS

Partial International Search Report for PCT/US2008/070771.
Crayola® Products, "Products Home: For Home for the Classroom," Retrieved from the Internet on Jan. 15, 2008: URL:http://www.crayola.com/products/list.cfm?categories=MARKERS&categories=Specialty.

* cited by examiner

*Primary Examiner* — Davis Hwu
(74) *Attorney, Agent, or Firm* — Marshall, Gerstein & Borun LLP

(57) ABSTRACT

A writing instrument includes a barrel having a hollow channel, an open end and a closed end. A cartridge is slidably movable in the hollow channel and the cartridge has a nib in fluid communication with a reservoir. An arm is pivotably mounted to the barrel and a cap is attached to the arm, the cap is adapted to close the open end of the barrel when the arm is in a closed position. As the arm pivots, moving the cap from the closed position to an open position, the cartridge extends toward the open end of the barrel and exposes the nib. When the arm is rotated approximately 180 degrees, the nib is fully extended and ready for use.

23 Claims, 13 Drawing Sheets

CLOSED POSITION

INTERMEDIATE POSITION

OPEN POSITION

RETRACTABLE NIB WRITING INSTRUMENT

BACKGROUND

1. Field of the Invention

The invention generally relates to a writing instrument with a retractable nib and specifically relates to a fountain pen having an attached cap and a retractable nib.

2. Related Technology

Conventional writing instruments have a separate cap that protects the nib and prevents the writing instrument from drying out. Additionally, most conventional writing instrument caps have a clip that can be used to secure the writing instrument to another object when the writing instrument is not in use. For example, the clip may be used to secure the writing instrument in a shirt pocket. When the cap is removed in order to use the writing instrument, the cap is unattached and thus the cap is easily misplaced or lost, and the writing instrument becomes susceptible to drying out and cannot be attached to an object.

GENERAL DESCRIPTION

A writing instrument constructed in accordance with the teachings of the disclosure includes a barrel having a hollow channel, an open end and a closed end. A cartridge is slidably movable in the hollow channel and the cartridge has a nib in fluid communication with a reservoir. An arm is pivotably mounted to the barrel and a cap is attached to the arm, the cap is adapted to close the open end of the barrel when the arm is in a closed position. As the arm pivots, moving the cap from the closed position to an open position, the cartridge extends toward the open end of the barrel and exposes the nib. When the arm is rotated approximately 180 degrees, the nib is fully extended and ready for use.

The writing instrument described herein advantageously provides a cap which is not separable from the writing instrument. Thus, the cap is not easily misplaced or lost. Additionally, the cartridge may be easily and quickly replaced as a unit thus reducing the chance of spilling ink during refill. Further, the arms rotate away from the front end of the barrel where a user will generally hold the writing instrument. Thus, a gripping area on the front of the barrel may be kept free and unobstructed during use. Additionally, the pivoting action of the arms coupled with the sliding action of the cartridge provide a well balanced writing instrument. The change in the center of gravity due to the rearward pivoting of the arms may be offset by a similar change in the center of gravity due to the forward sliding of the cartridge. In this way, the overall center of gravity of the instrument may be maintained throughout the range of motion of the arms.

BRIEF DESCRIPTION OF THE DRAWINGS

Further features and advantages of the invention can be gathered from the claims, the following description, and the attached diagrammatic drawings, wherein:

DETAILED DESCRIPTION

Figure 1:
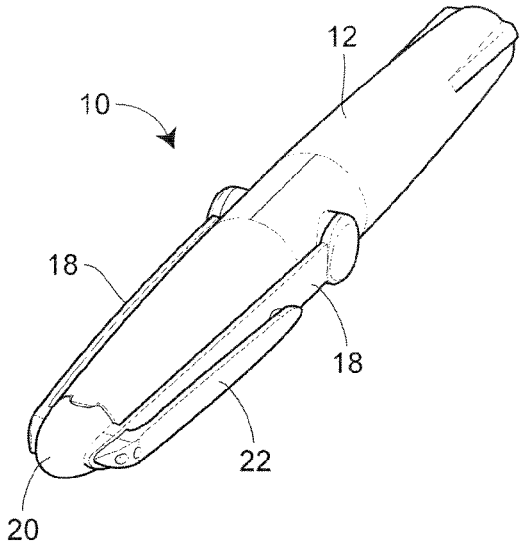
FIG. 1 is a perspective view of a writing instrument constructed in accordance with the disclosure, the writing instrument being in a closed condition.

A fountain pen 10 is exemplified in the drawings, however, other writing instruments including, but not limited to markers, highlighters, ball pens, felt tip pens, and other fluid application devices including, but not limited to, correction fluid applicators and paint applicators could also be made in accordance with the teachings of the disclosure by selection of appropriate components. Similarly, other types of tools such as utility blades, screw drivers, punches, flashlights, etc., may be constructed in accordance with the teachings of the disclosure by substituting a tool for a nib. The fountain pen 10 comprises an outer hollow barrel 12 having an opening 14 at one end thereof through which a nib 16 extends and retracts. First and second arms 18 are rotatably attached to the outer barrel 12. A cap 20 is attached to the first and second arms 18. The nib 16 extends and retracts through the opening 14 as a result of a pivoting movement of the first and second arms 18. A clip 22 may be attached to one of the first and second arms 18 to attach the fountain pen 10 to an object, such as a shirt pocket, when the fountain pen 10 is not in use.

FIG. 1 is a perspective view of the fountain pen 10 with the cap 20 and first and second arms 18 in a closed, capped position. In the closed, capped position, the nib 16 (not shown in FIG. 1) retracts within the outer barrel 12 and the cap 20 covers and seals the opening 14. Thus, in the closed, capped position the cap 20 prevents evaporation of ink from the fountain pen 10 (i.e., "drying-out" of the fountain pen). The cap 20 also protects the nib 16 from environmental damage in the closed, capped position.

Figure 2:
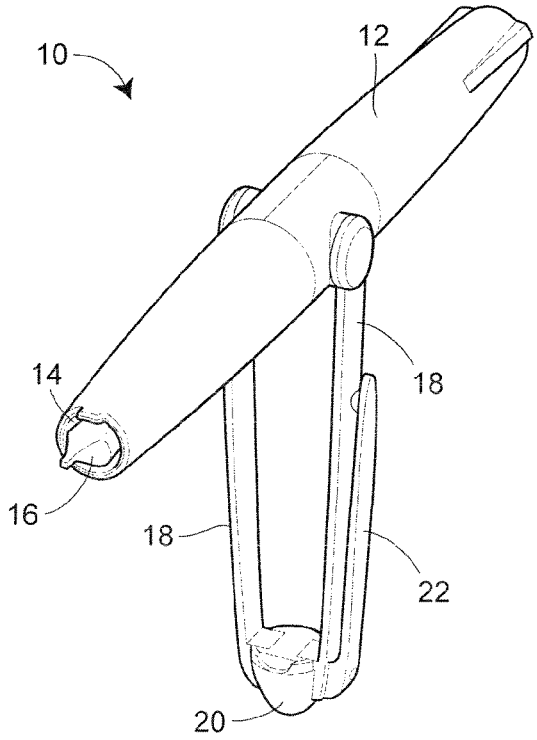
FIG. 2 is a perspective view of the writing instrument of FIG. 1 in a partially open condition.

FIG. 2 is a perspective view of the fountain pen 10 with the cap 20 and first and second arms 18 in an intermediate position. As the cap 20 and first and second arms 18 pivot away from the closed, capped position of FIG. 1 towards an open, writing position (shown in FIG. 3), the nib 16 begins to extend through the opening 14. The nib 16 extends at a rate proportional to the rotation of the first and second arms 18.

Figure 3:
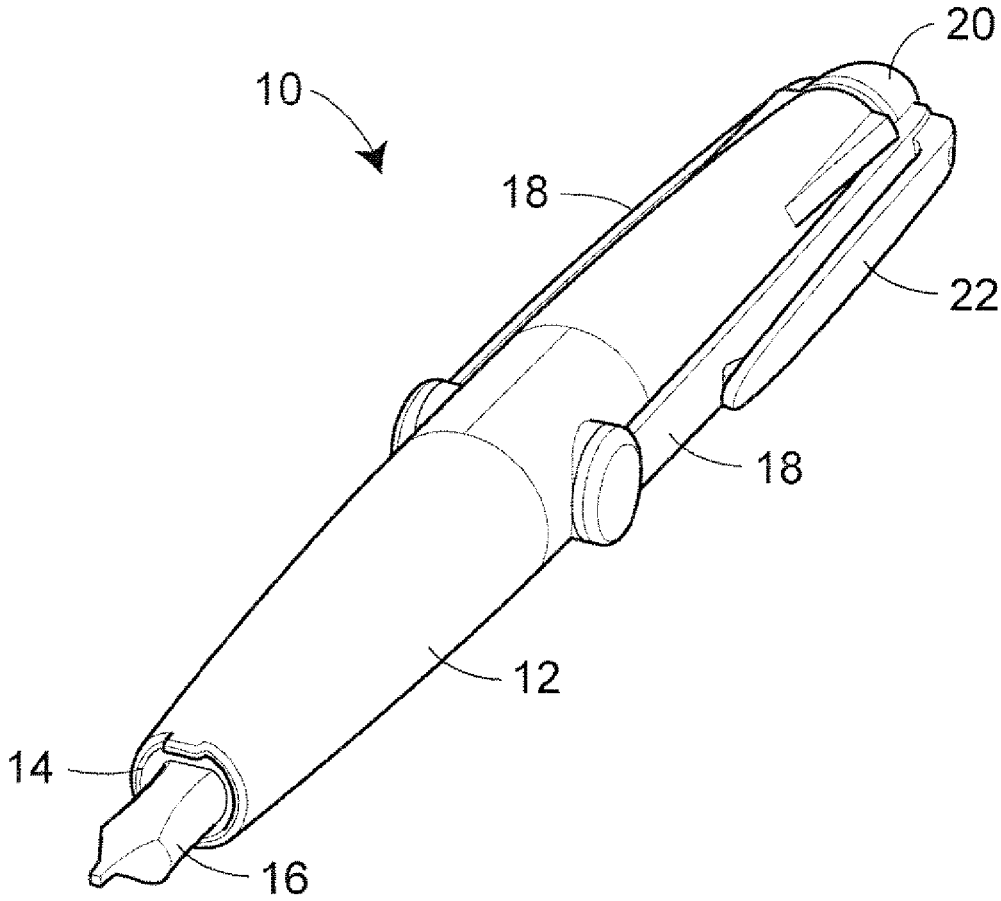
FIG. 3 is a perspective view of the writing instrument of FIG. 1 in a fully open position.

FIG. 3 is a perspective view of the fountain pen 10 with the cap 20 and first and second arms 18 in the open, writing position. In the open, writing position, the nib 16 is fully extended through the opening 14 and the arms are approximately 180 degrees rotated from the closed, capped position of FIG. 1. The open, writing position shown in FIG. 3 is a position where the nib 16 is accessible for writing. In this embodiment, the nib 16 comprises a fountain pen nib having an angular flexible section that terminates in a ball-like tip. The fountain pen nib may be made from precious metals such as gold, platinum, and the like as is known in the art. However, the nib 16 is not limited to a fountain pen nib and may include writing instrument nibs of any sort. For example, a ball point or maker nib could be employed. Additionally, a brush applicator or a foam applicator could be used in combination with a correction fluid or paint applicator, of course, marker type applicators could be used with such correction fluid and paint applicators.

Figure 4:
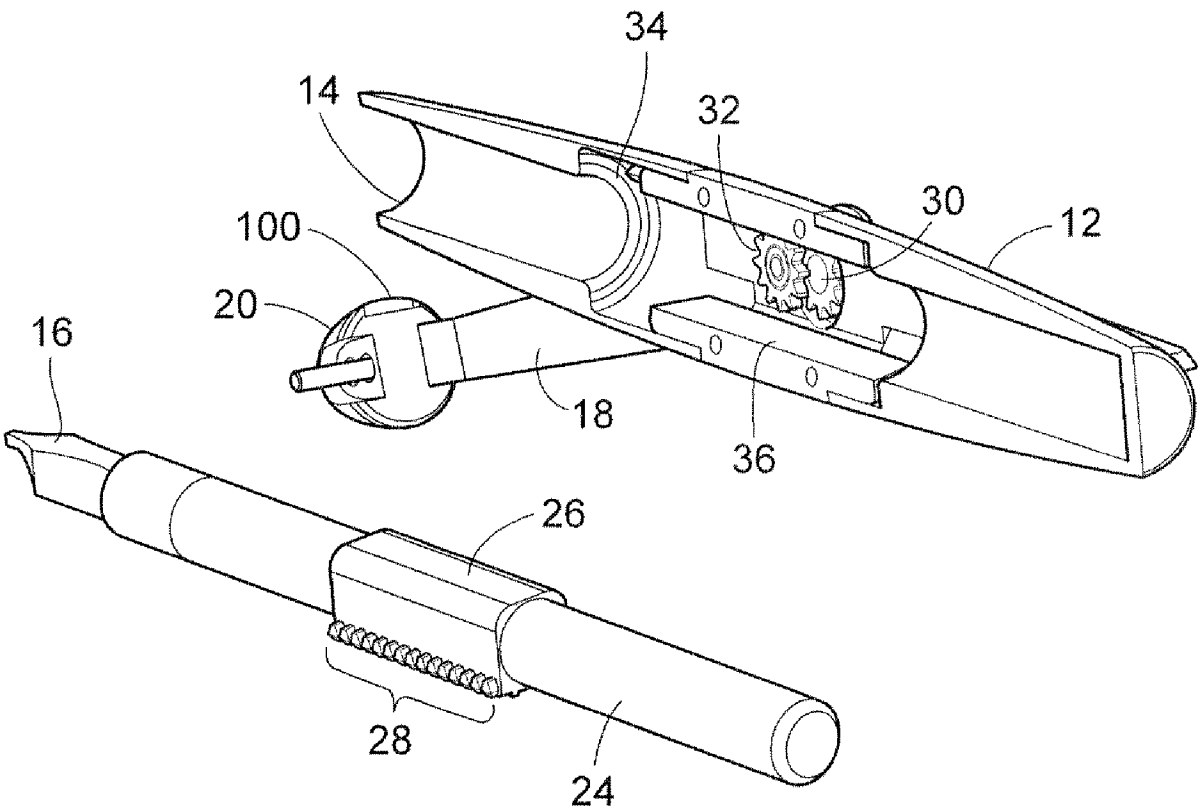
FIG. 4 is perspective partially cutaway and exploded view of the writing instrument of FIG. 1.

FIG. 4 shows an exploded perspective view of the fountain pen 10. In this view, only one half of the outer barrel 12 is shown. The non shown half of the outer barrel 12 is a mirror image of the half shown. The nib 16 is attached to an ink cartridge 24 that includes a reservoir (not shown). The reservoir may hold ink, correction fluid, paint, etc. depending on the type of writing instrument and/or marking device employed. Additionally, the reservoir may be any type of liquid reservoir. For example, the reservoir may be a free ink reservoir (for fountain pens, markers, felt tip pens, etc.), a fibrous reservoir (for markers, etc.), a tube reservoir with a follower (for ball pens), a cartridge reservoir, or any other known liquid reservoir.

In the embodiment of FIG. 4, ink from an ink reservoir is fluidly connected to the nib 16. The ink cartridge 24 includes a sleeve 26 that is disposed around an outer surface of the ink cartridge 24. In this embodiment, the sleeve 26 completely surrounds a portion of the ink cartridge 24. However, the sleeve 26 may comprise one or more partial sleeves 26 that may or may not completely surround the ink cartridge 24. The sleeve 26 may also be integral with the ink cartridge 24 if desired. The sleeve 26 includes a plurality of teeth 28 that mesh with teeth on one or more gears 30 disposed inside the outer barrel 12. In the embodiment of FIG. 4, the sleeve has two sets of sleeve teeth 28 (one is hidden on the far side of the sleeve in FIG. 4). However, the sleeve may include only one set of sleeve teeth 28. The one or more gears 30 are connected to both of the first and second arms 18 respectively and rotate as the first and second arms 18 pivot. As the one or more gears 30 rotate, gear teeth 32 mesh with the sleeve teeth 28 thereby causing the sleeve 26 (and the ink cartridge 24) to slide longitudinally within the outer barrel 12. In another embodiment (not shown), the fountain pen 10 includes a gear or gears 30 that are attached to only one arm.

An annular shoulder 34 extends from an inner surface of the barrel 12. The shoulder 34 forms a stop which limits forward travel of the ink cartridge 24. The first and second arms 18 and gears 30 are arranged such that when the first and second arms 18 reach the open, writing position of FIG. 3, the ink cartridge 24 reaches a fully forward travel location in which a front edge of the sleeve 26 abuts the shoulder 34 thereby stabilizing the ink cartridge 24 within the barrel 12. Furthermore, one or more shelves 36 extend from the inner surface of the barrel 12. The shelves 36 support and guide the ink cartridge 24 during extension and retraction.

Figure 5:
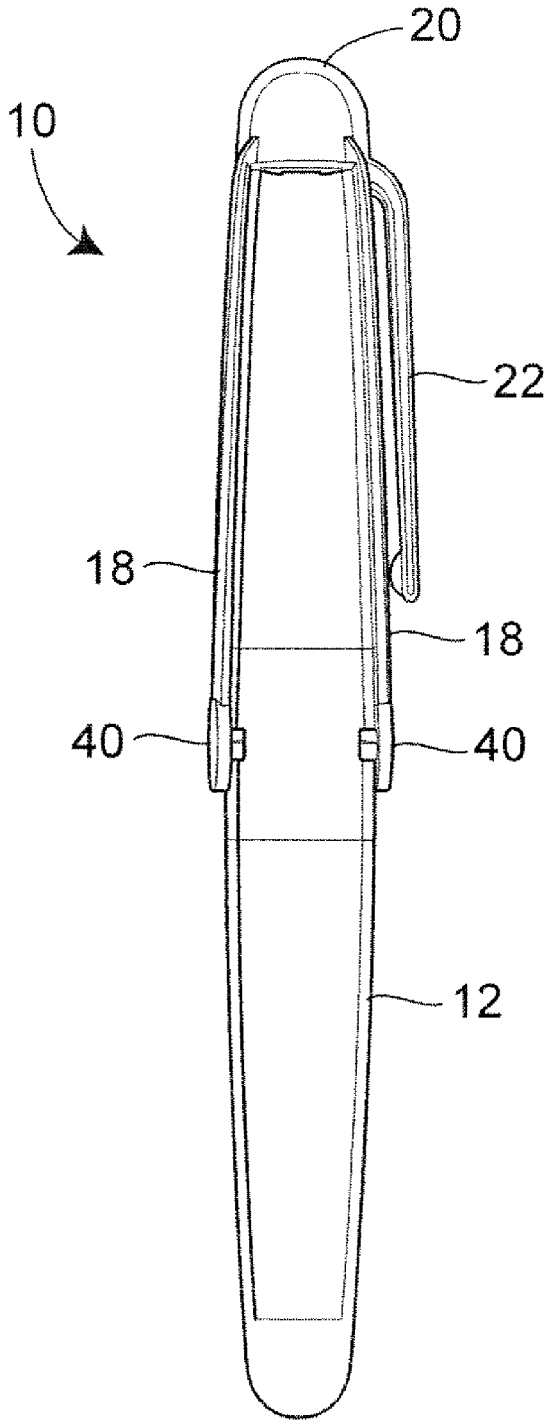
FIG. 5 is a longitudinal cut away view of the barrel, arms and cap of the writing instrument of FIG. 1.

FIG. 5 shows a longitudinal cross section of the fountain pen 10. The first and second arms 18 are rotatably attached to the barrel 12 at respective hubs 40 that extend through the barrel 12. The hubs 40 may be connected to the gears 30 (FIG. 4) by any known method such as press-fit, adhesives and/or fasteners. The clip 22 may be attached to one arm 18, or the clip 22 may be integrally formed with one arm 18.

Figure 6:
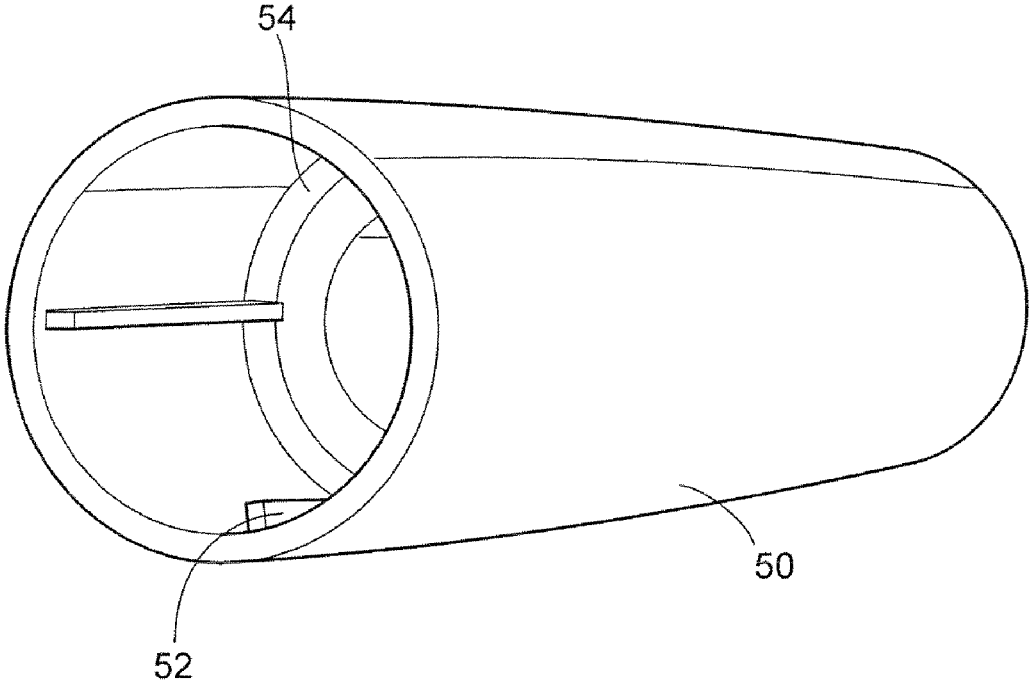
FIG. 6 is a perspective view of a bottom portion of the barrel of the writing instrument of FIG. 1.

In one embodiment, the outer barrel 12 may be formed in sections. FIG. 6 shows a rear barrel section 50. The rear barrel section 50 is a hollow tube that is closed at one end and open at another end. The rear barrel section 50 may include one or more ribs 52 and/or rings 54 to strengthen the rear barrel section 50 while reducing material required for the rear barrel section 50.

Figure 7:
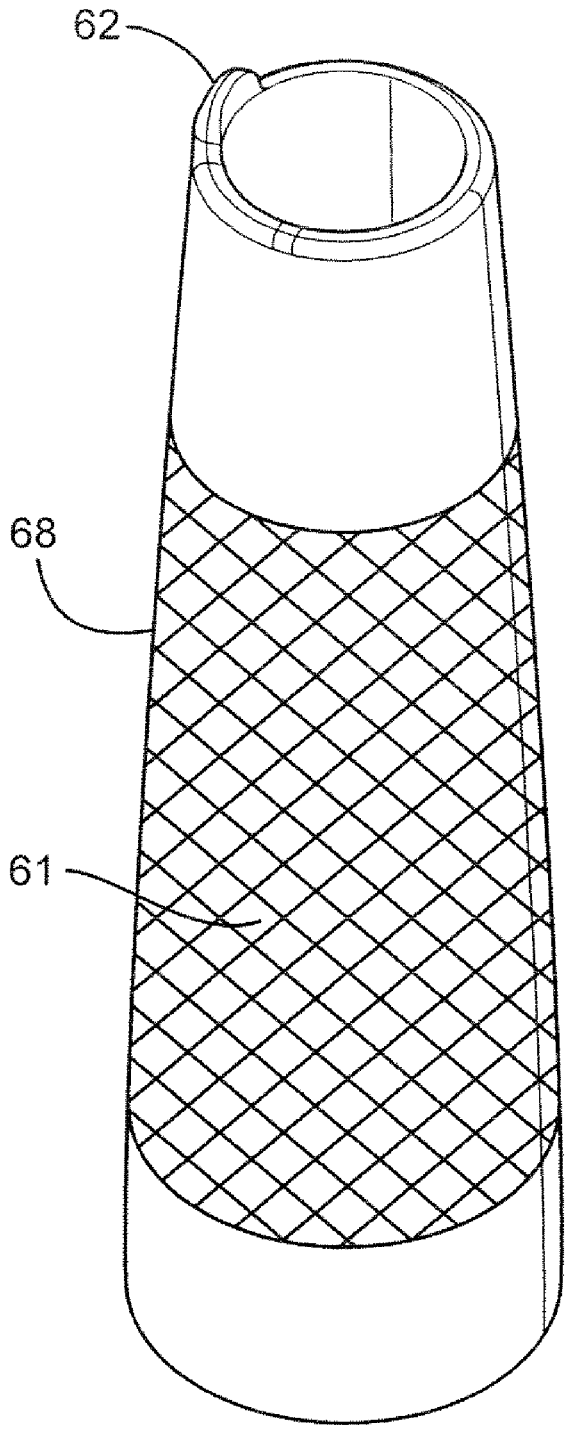
FIG. 7 is a perspective view of a top portion of the barrel of the writing instrument of FIG. 1.

FIG. 7 shows a front barrel section 60. The front barrel section 60 is a hollow tube, like the rear barrel section 50. However, the front barrel section 60 is open at both tube ends. The front barrel section 60 provides a gripping area 61 that may be covered by a comfortable gripping material if desired. The front barrel section 60 may taper from one end towards another end forming a gentle cone shape. Additionally, one end of the front barrel section 60 may include an alignment shoulder 62. The alignment shoulder 62 cooperates with an alignment notch (discussed further hereinafter) on the cap 20 to properly align and seat the cap 20 on the front barrel section 60 when the cap 20 and first and second arms 18 are in the closed, capped position shown in FIG. 1.

Figure 8:
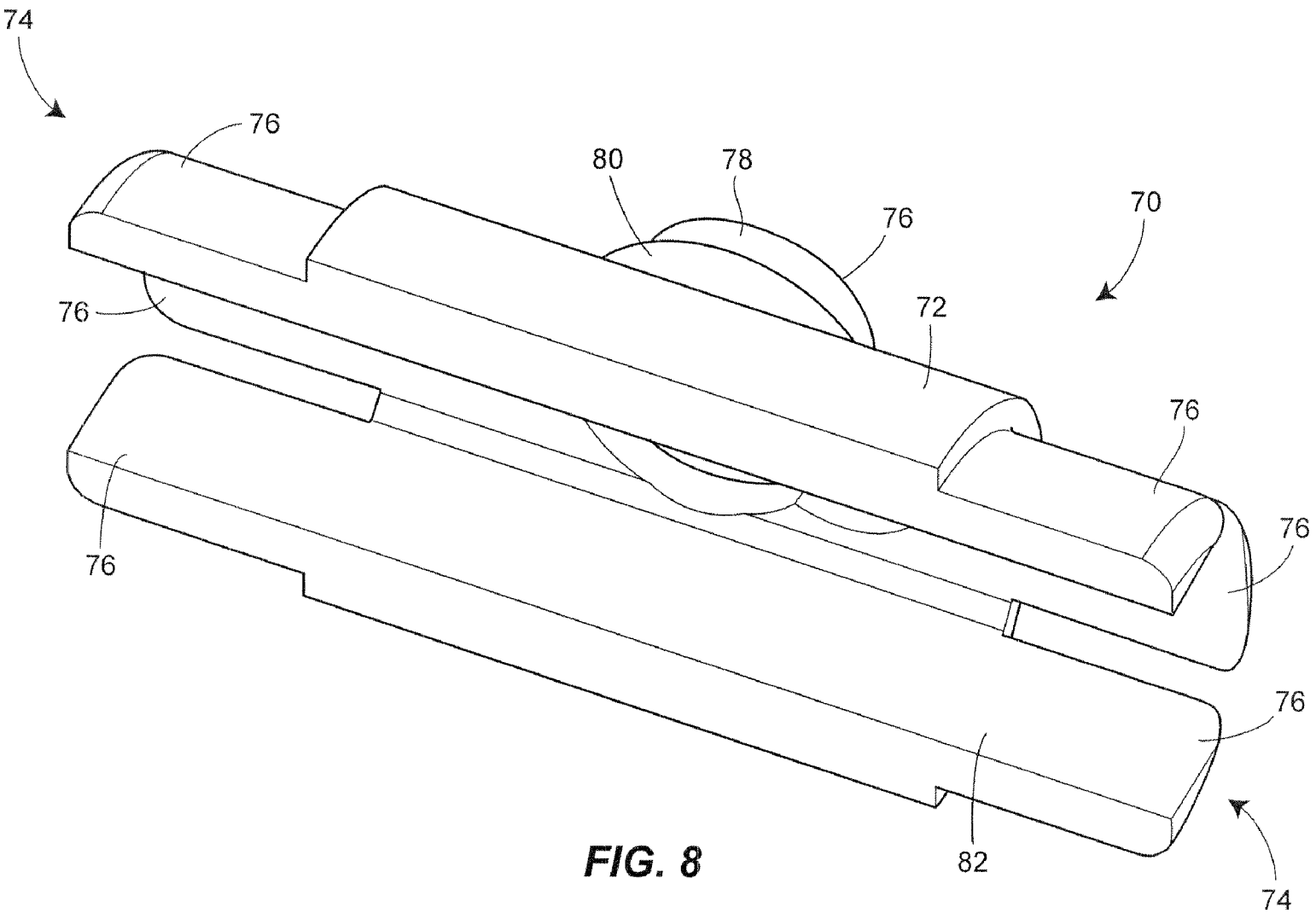
FIG. 8 is a bottom perspective view of a coupler assembly that connects the top and bottom portions of the barrel of the writing instrument of FIG. 1.
Figure 9:
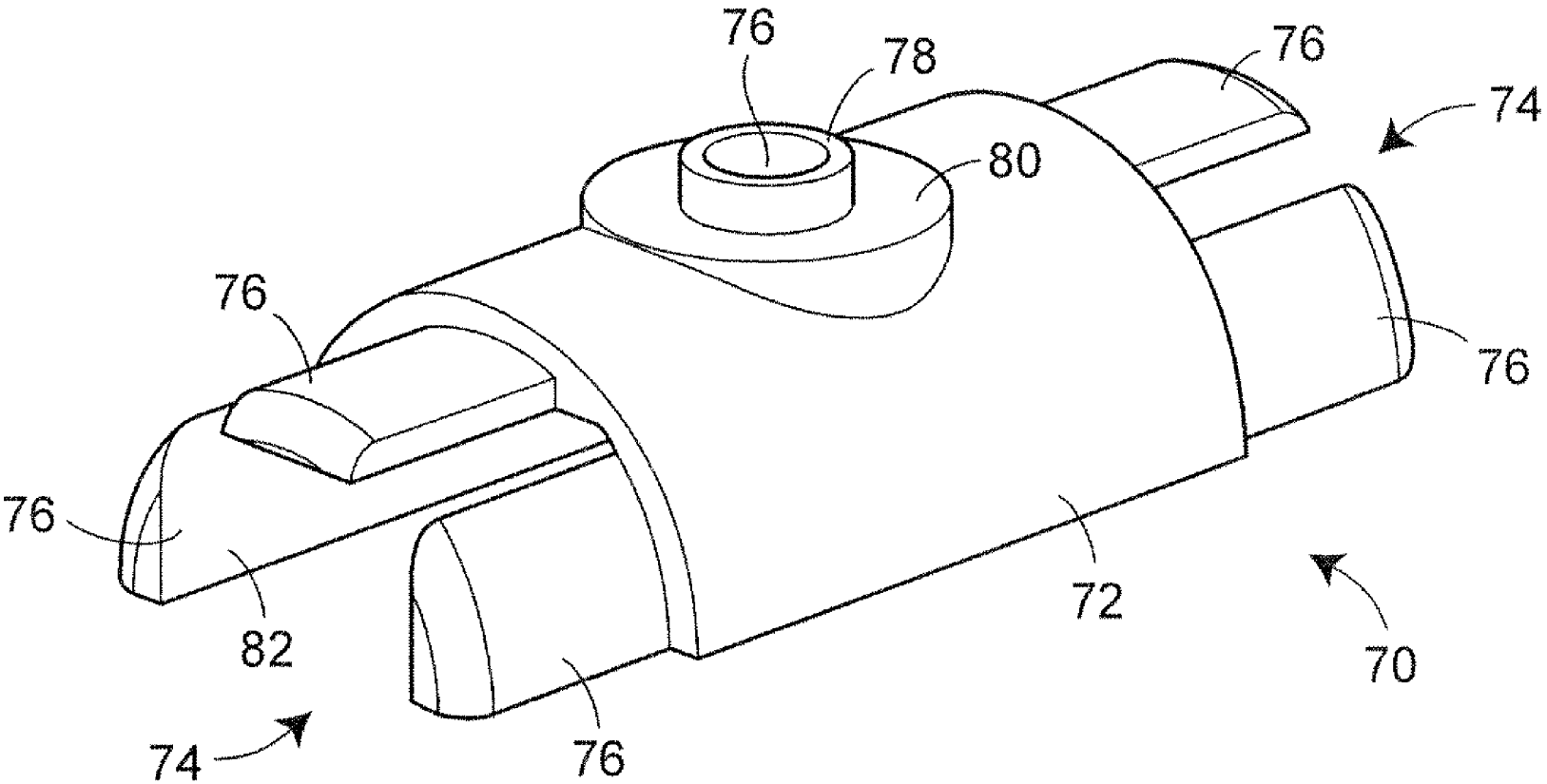
FIG. 9 is a top perspective view of the coupler assembly of FIG. 8.

The rear barrel section 50 and the front barrel section 60 may be connected to one another by a coupling section 70, which is shown in FIGS. 8 and 9. The coupling section 70 may include a center portion 72 and two end portions 74, the end portions 74 having a smaller outer diameter than the center portion 72. The end portions 74 may include one or more tabs 76. Alternately, the one or more tabs 76 may be joined to form a single annular flange (not shown). The one or more tabs 76 (or annular flanges) are inserted into the front barrel section 60 and the rear barrel section 50 respectively thereby joining both the front barrel section 60 and the rear barrel section 50 to the coupling section 70. The rear barrel section 50, front barrel section 60 and the coupling section 70 form the outer barrel 12.

The coupling section may include one or more openings 76 that accommodate the hub 40 for the first and second arms 18. The openings 76 may be surrounded by a flange 78 and pedestal 80 if desired. The flange 78 and pedestal 80 cooperate with the first and second arms 18 to form a smooth appealing connection between the first and second arms 18 and the outer barrel 12 while allowing the first and second arms 18 to pivot with respect to the outer barrel 12. The flange 78 receives an axle (See FIGS. 10-12) thereby aligning and stabilizing the arm about a pivot axis. The pedestal provides a locating surface to prevent the arms 18 from being pushed too far into the opening 76. Inner surfaces 82 of the one or more tabs 76 form generally planar guiding surfaces that corral the sleeve 26 and thus guide and support the ink cartridge 24 during longitudinal translation of the ink cartridge 24 within the barrel 12.

Figure 10:
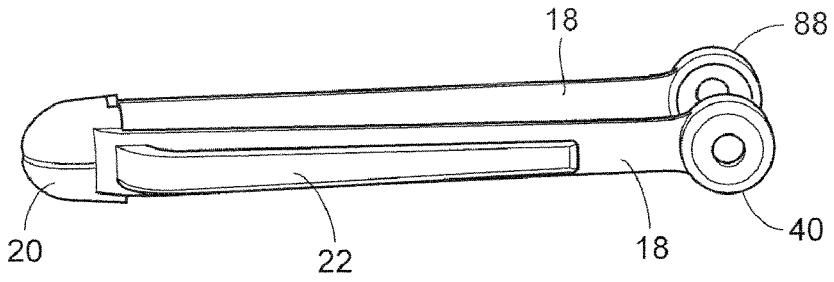
FIG. 10 is a perspective view of the arms of the writing instrument of FIG. 1.
Figure 11:
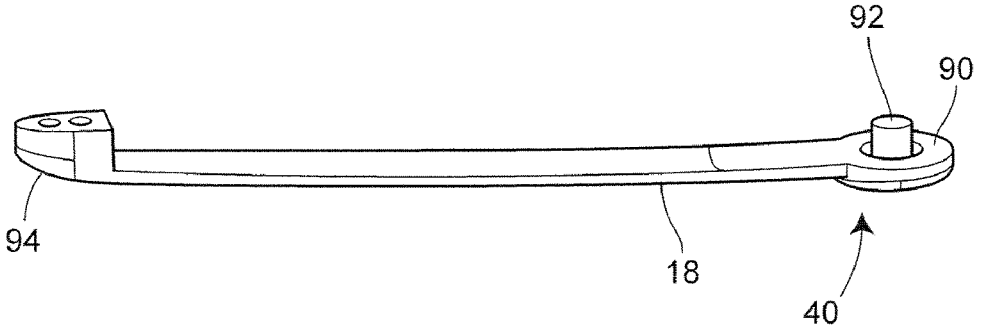
FIG. 11 is a perspective view of one of the arms of FIG. 10.
Figure 12:
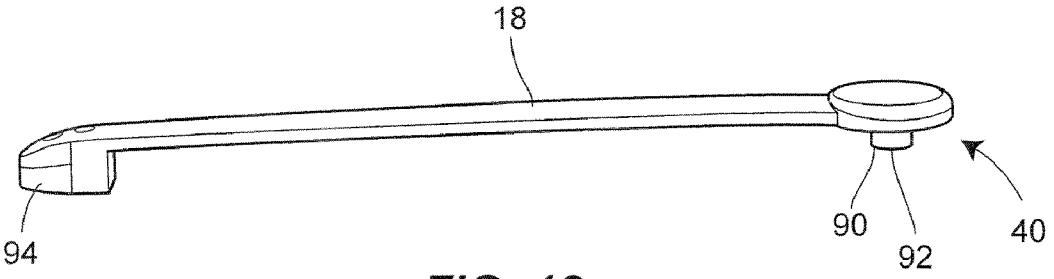
FIG. 12 is another perspective view of the arm of FIG. 11.

FIGS. 10-12 show the first and second arms 18 of the fountain pen 10. The first and second arms 18 are joined to one another at the cap 20. While the embodiment shown in FIGS. 10-20 includes two arms 18, other embodiments may only include a single arm 18. At ends opposite the cap 20 each arm includes the hub 40. The hub 40 includes an annular shoulder surface 90 and an axle 92. Each axle 92 is inserted through one opening 76 in the coupling portion 70 and each axle 92 is connected to one gear 30 (FIG. 4). The annular shoulder surface 90 abuts the pedestal 80 on the coupling section 70 to stabilize the first and second arms 18 in respective openings 76 and to prevent the arms 18 from being pushed too far into the openings 76. At an end opposite the hub 40, each arm includes a foot 94 that fits into a recess 96 (FIG. 13) on the cap 20. The foot 94 may be secured to the cap 20 via any known means, such as, adhesives, fasteners, press-fit, etc. Alternatively, the cap may be integrally molded with one or both of the arms.

Figure 13:
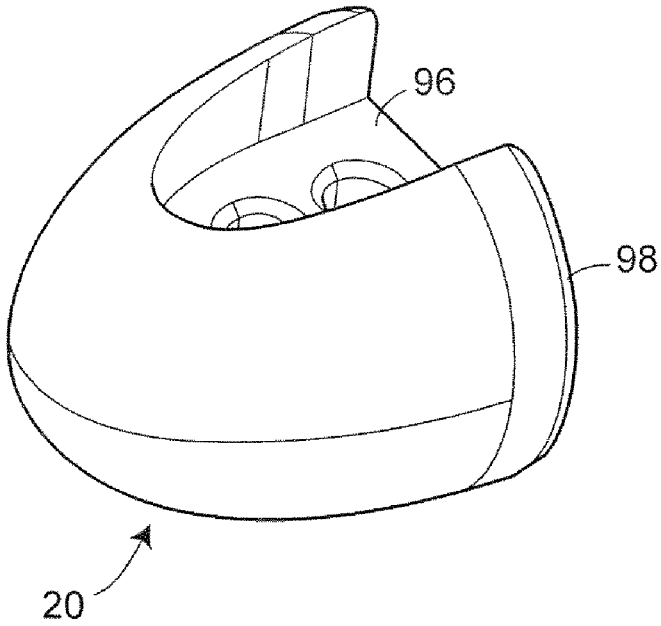
FIG. 13 is a perspective view of the cap of the writing instrument of FIG. 1.

FIG. 13 shows the cap 20. The cap 20 is generally conical in shape and includes two recesses 96 opposite one another. As discussed earlier, the recesses 96 receive the feet 94 of the first and second arms 18 thereby securing the first and second arms 18 to the cap 20. Additionally, the cap 20 may include a seal 98. The seal 98 may be disposed on an inner surface of the cap 20 or along the end of the cap 20. The seal 98 provides a substantially air-tight fit between the cap 20 and the outer barrel 12 when the first and second arms 18 and cap 20 are in the closed, capped position shown in FIG. 1, thus preventing ink in the fountain pen 10 from drying out when the fountain pen 10 is not in use. Additionally, the cap includes an alignment notch that cooperates with the alignment shoulder 62 on the front barrel section 60. As the cap 20 is moved into the closed position of FIG. 1, the alignment notch engages the alignment shoulder 62 to ensure proper alignment of the cap 20 on the front barrel section 60.

Figure 14:
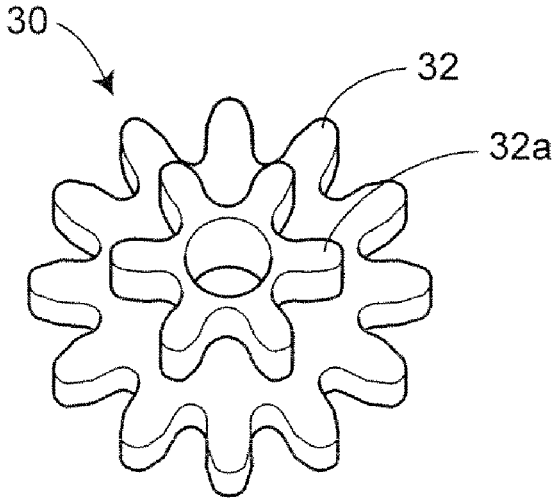
FIG. 14 is a perspective view of a gear that connects an arm to the ink cartridge of the writing instrument of FIG. 1.

FIG. 14 shows an example of the gear 30 that connects the first and second arms 18 to the sleeve 26. In this example, the gear 30 includes an outer plurality of teeth 32 and an inner plurality of teeth 32*a*. The inner plurality of teeth 32*a* are disposed about a circumference that is generally smaller than the circumference of the outer plurality of teeth 32. With this configuration, the ratio between the inner plurality of teeth 32*a* and the outer plurality of teeth 32 may be varied. For example, in one embodiment, the ratio may be approximately 1:2 between the inner plurality of teeth 32*a* and the outer plurality of teeth 32. Different ratios may provide faster or slower extension and retraction of the ink cartridge 24. Additionally, a second gear may be added (not shown), which reverses the extension/retraction of the ink cartridge 24 relative to the direction of arm 18 movement. Likewise, the outer plurality of teeth 32 and the inner plurality of teeth 32*a* may be disposed on separate gears 30.

Figure 15A:
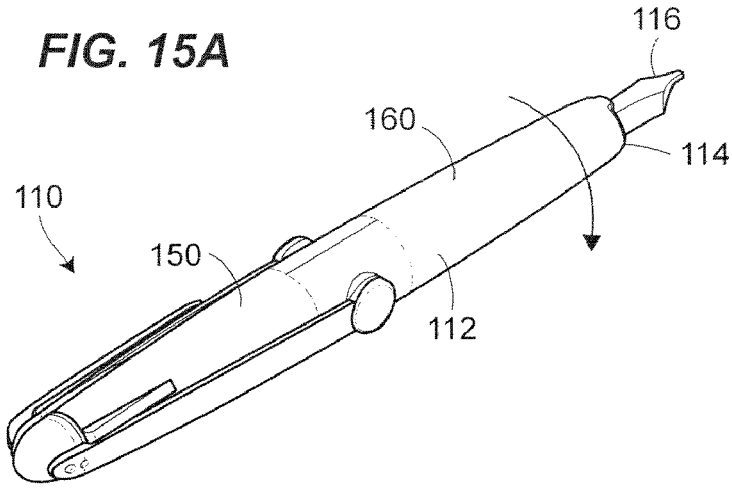
FIGS. 15A and 15B are perspective views of an alternate embodiment of a writing instrument constructed in accordance with the teachings of the disclosure.
Figure 15B:
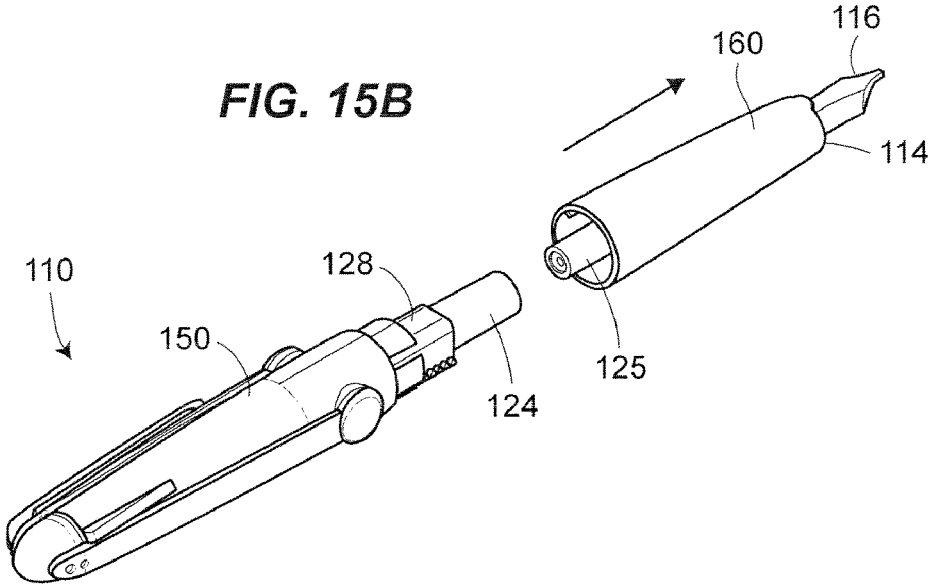

FIGS. 15A and 15B show an example of a second embodiment of a writing instrument 110 constructed in accordance with the teachings of the disclosure, wherein like elements are labeled exactly 100 greater than corresponding elements of the embodiment shown in FIGS. 1-14. The writing instrument 110 comprises an outer hollow barrel 112 having an opening 114 at one end thereof through which a nib 116 extends and retracts. The outer hollow barrel 112 comprises a rear barrel section 150 and a front barrel section 160.

Occasionally, the writing instrument 110 will be depleted of ink. An ink reservoir within the writing instrument 110 may be replaced when needed. To change the ink reservoir, the front barrel section 160 is rotated (as shown by the arrow in FIG. 15A) to unlock the front barrel section 160 from the rear barrel section in order to facilitate changing of an ink reservoir. The front barrel section 160 is preferably rotated between approximately 90 degrees and approximately five full turns to unlock the front barrel section 160 from the rear barrel section 150. However, any number of turns, or fractions thereof, may be required to unlock the front and rear barrel sections 160, 150. Once the front barrel section 160 is unlocked and detached from the rear barrel section 150, the front barrel section 160 is moved away from the rear barrel section 150 as shown in FIG. 15B exposing the ink reservoir 125.

Figure 16:
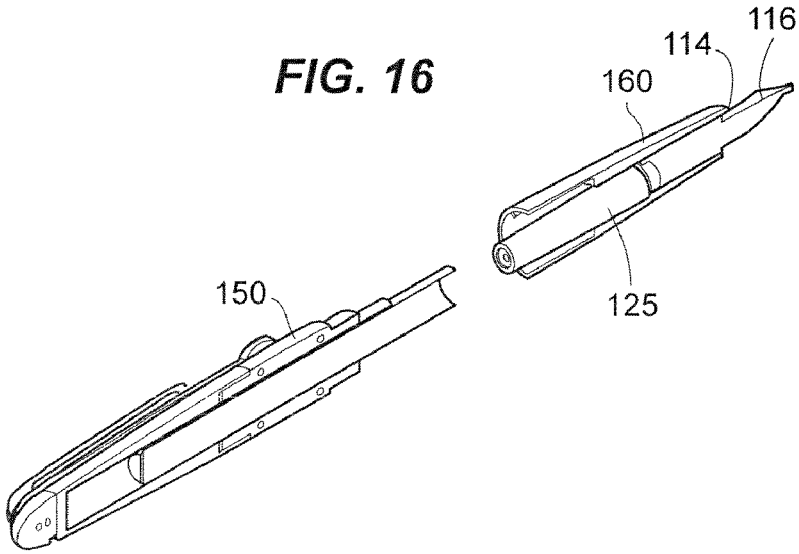
FIG. 16 is a cut-away perspective view of the writing instrument of FIGS. 15A and 15B.
Figure 17A:
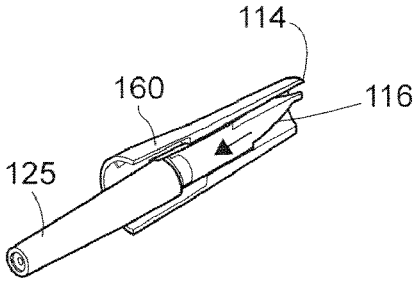
FIGS. 17A-17D are perspective cut-away views of the front barrel of the writing instrument of FIGS. 15A and 15B during changing of the ink reservoir.
Figure 17B:
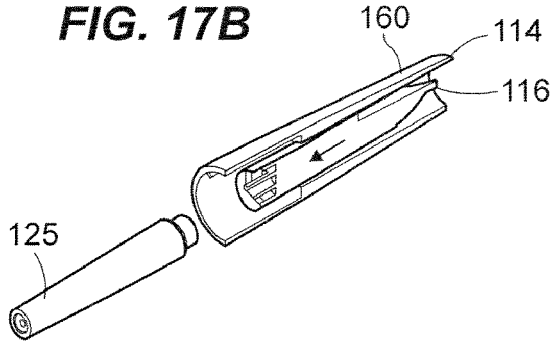

As seen in FIG. 16, the ink reservoir 125 is detachably connected to the nib 116. The nib 116 is in fluid communication with ink stored in the ink reservoir 125 and the ink stored in the ink reservoir 125 flows to the nib 116 for depositing on a substrate. Once the front barrel 160 is removed from the rear barrel 150, the nib 116 is moved rearward, away from the opening 114 until the nib 116 contacts a rear edge of the front barrel section 160 (FIG. 17B), thereby forcing the ink reservoir 125 out of the back of the front barrel 160. The depleted ink reservoir 125 is removed from the nib 116 as shown in FIG. 17B.

Figure 17C:
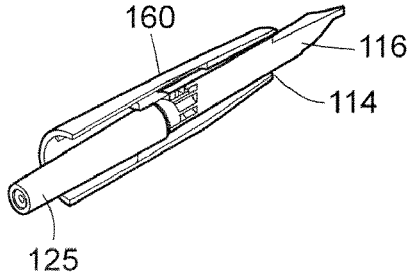
Figure 17D:
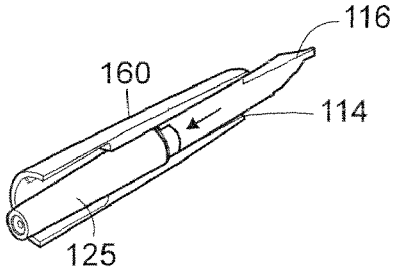
Figure 18A:
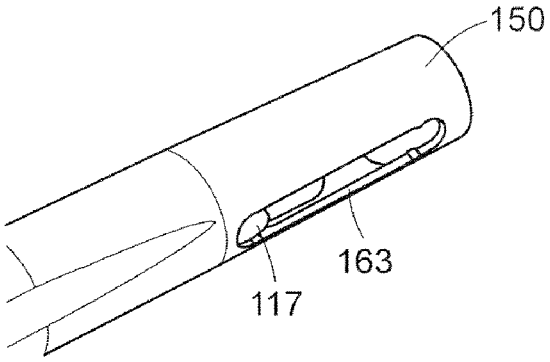
FIGS. 18A and 18B are close up partially cut-away views of a portion of the rear barrel of the writing instrument of FIGS. 15A and 15B showing a slot and an internal stop.
Figure 18B:
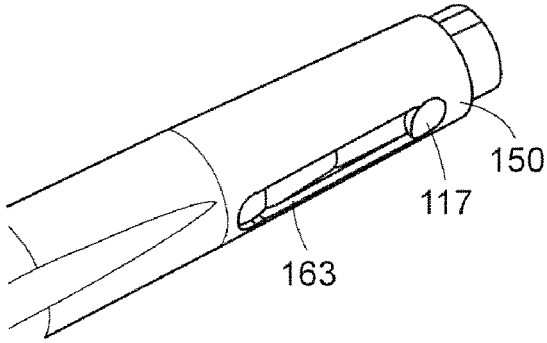

A fresh ink reservoir 125 is positioned within the front barrel 160 as shown in FIG. 17C. The fresh ink reservoir 125 pushes the nib 116 forward, towards the opening 114, until the nib 116 contacts a forward edge of the front barrel section 160 as shown in FIG. 17D. When the nib 116 is in the forward position shown in FIG. 17D, the fresh ink reservoir 125 is pushed towards the nib 116 to positively seat the fresh ink reservoir 125 on the nib 116, once again providing ink to the nib 116. A channel 163, shown in partially cut-away FIGS. 18A, 18B is disposed on an interior of the rear barrel section 150 and provides stops for the nib 116 during normal operation of the writing instrument 110 The stops prevent over-extension of the nib 116 and thus over-rotation of the arms 118. A post 117 disposed on the nib slidably engages within the channel 163 to limit forward and rearward movement of the nib 116.

Figure 19:
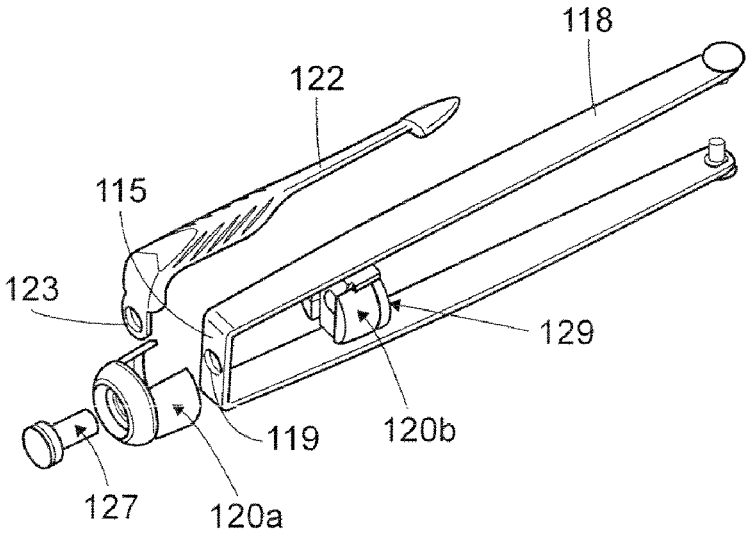
FIG. 19 is an exploded perspective view of the arms, clip and cap of the writing instrument of FIGS. 15A and 15B.

FIG. 19 shows an exploded view of the arms 118, clip 122 and cap 120*a*, 120*b* of the writing instrument 110 of FIGS. 15A and 15B. In this embodiment, the arms 118 are joined by a connecting portion 115 having an opening 119. However, other embodiments may include a one piece arm 118 or a two piece arm 118. The clip 122, likewise includes an opening 123. The cap 120 in this embodiment includes a first cap portion 120*a* and a second cap portion 120*b*. The first and second cap portions 120*a*, 120*b* also have openings. The second cap portion 120*b* includes a seal part 129 that cooperates with the opening 114 of the front barrel 160 to seal the nib 116 when the writing instrument is in the closed position. To assemble the arms 118, clip 122 and cap 120*a*, 120*b*, openings in the first cap portion 120*a*, clip 122, arms 118, and second cap portion 120*b* are aligned and a rivet 127 is inserted into the openings thereby securing the cap 120, clip 122 and arms 118 to one another.

The disclosure is not limited to a fountain pen. The disclosure could be applied to virtually any writing instrument or tool, such as utility blades, flashlights, screw drivers, or other similar instruments. The features of the invention disclosed in the description, drawings and claims can be individually or in various combinations for the implementation of the different embodiments of the invention.

The invention claimed is:

1. An instrument comprising:

a barrel having a hollow channel, an open end and a closed end;

a cartridge slidably movable in the hollow channel, the cartridge having a nib and in fluid communication with an ink reservoir;

a first arm pivotably mounted to an outside of the barrel, the first arm capable of pivoting between a closed, capped position and an open, writing position;

a cap attached to the first arm, the cap adapted to close the open end of the barrel when the first arm is in the closed, capped position;

a first gear disposed in the hollow channel, the first gear being coupled to the first arm; and a sleeve disposed on the cartridge, the sleeve having teeth projecting from an outer surface of the sleeve, the teeth and the first gear cooperating to extend and retract the cartridge as the first arm is pivoted.

2. The instrument of claim 1 further comprising a second gear disposed between the first gear and the sleeve.

3. The instrument of claim 2 wherein the first and second gears have different circumferences.

4. The instrument of claim 3 wherein a gear ratio of the first gear circumference to the second gear circumference is approximately 2:1.

5. The instrument of claim 1 further comprising a gripping area on the outer surface of the barrel.

6. The instrument of claim 1 wherein the nib comprises a fountain pen nib.

7. The instrument of claim 1 further comprising a seal disposed on an interior surface of the cap.

8. The instrument of claim 1 further comprising an alignment notch disposed on the cap.

9. The instrument of claim 8 further comprising an alignment shoulder disposed on the open end of the barrel, the alignment shoulder fitting into the alignment notch when first arm is in the closed, capped position.

10. The instrument of claim 8, wherein the cap snaps into an alignment position in both the open and closed position.

11. The instrument of claim 1 wherein the barrel comprises a front barrel section and a rear barrel section connected by a coupling section.

12. The instrument of claim 11 wherein the opening is surrounded by a flange and a pedestal, the flange and the pedestal cooperating with the first arm to stabilize the first arm on the coupling section.

13. The instrument of claim 1 wherein the nib comprises a flexible, angular nib that terminates in a ball-like tip.

14. The instrument of claim 13 wherein the nib is made of a precious metal.

15. The instrument of claim 1 wherein the instrument is selected from the group consisting of a writing instrument, a correction fluid applicator and a paint applicator.

16. An instrument comprising:

a barrel having a hollow channel, an open end and a closed end;

a cartridge slidably movable in the hollow channel, the cartridge having a nib and in fluid communication with an ink reservoir;

a first arm pivotably mounted to an outside of the barrel, the first arm capable of pivoting between a closed, capped position and an open, writing position;

a cap attached to the first arm, the cap adapted to close the open end of the barrel when the first arm is in the closed, capped position;

a first gear disposed in the hollow channel, the first gear being coupled to the first arm; and a second arm pivotably mounted to the outside of the barrel opposite the first arm, the second arm being attached to the cap, the first and second arms pivoting together as the cap is moved from the closed, capped position to the open, writing position.

17. An instrument comprising:

a barrel having a hollow channel, an open end and a closed end;

a cartridge slidably movable in the hollow channel, the cartridge having a nib and in fluid communication with an ink reservoir;

a first arm pivotably mounted to an outside of the barrel, the first arm capable of pivoting between a closed, capped position and an open, writing position;

a cap attached to the first arm, the cap adapted to close the open end of the barrel when the first arm is in the closed, capped position; and a first gear disposed in the hollow channel, the first gear being coupled to the first arm, wherein the barrel comprises a front barrel section and a rear barrel section connected by a coupling section and the coupling section comprises an opening adapted to receive an axle disposed on the first arm.

18. A writing instrument comprising:

a barrel having a hollow channel, an open end and a closed end;

a cartridge slidably movable in the hollow channel, the cartridge having a nib in fluid communication with an ink reservoir;

first and second arms pivotably mounted to an outside of the barrel, the first and second arms being capable of pivoting between a closed, capped position and an open, writing position;

a cap attached to the first and second arms, the cap adapted to close the open end of the barrel when the first and second arms are in a closed, capped position; and a first gear disposed in the hollow channel, the first gear being coupled to the first arm.

19. The writing instrument of claim 18 further comprising a second gear within the barrel, each of the first and second gears being coupled to one of the first and second arms and each of the first and second gears comprising a plurality of gear teeth.

20. The writing instrument of claim 19 further comprising a sleeve disposed around a portion of the cartridge, the sleeve comprising a plurality of sleeve teeth.

21. The writing instrument of claim 20, wherein the gear teeth and sleeve teeth cooperate to slide the cartridge longitudinally within the barrel.

22. The writing instrument of claim 18 wherein the nib is retracted within the barrel when the first and second arms are in the closed, capped position and the nib is extended outside the barrel when the first and second arms are in the open, writing position.

23. A fountain pen comprising:

a barrel having a hollow channel and an opening at one end, the barrel comprising a rear barrel section and a front barrel section joined by a coupling section, the coupling section comprising a center portion and two end portions of smaller outer diameters than the center portion;

a pair of openings disposed in the coupling section;

a pair of arms rotatably mounted to the barrel through the pair of openings;

a cap connected to each of the pair of arms;

a pair of gears disposed inside the barrel and connected to respective arms, each of the gears rotating as the arms pivot and each gear including a plurality of gear teeth;

an ink cartridge slidably movable in the barrel, the ink cartridge comprising an ink reservoir in fluid communication with a fountain pen nib; and a sleeve disposed around a portion of the ink cartridge, the sleeve comprising a plurality of teeth that mesh with the plurality of teeth on one of the pair of gears;

wherein the cap closes and seals the opening in the barrel when the arms are in a closed, capped position, and wherein as the arms and cap pivot away from the closed, capped position to an open, writing position, the gears rotate thereby driving the ink cartridge longitudinally within the barrel such that the nib extends outward beyond the opening.

* * * * *